US007470105B2

(12) United States Patent
de Oliveira

(10) Patent No.: US 7,470,105 B2
(45) Date of Patent: Dec. 30, 2008

(54) CYLINDRICAL ROTOR WITH INTERNAL BLADES

(76) Inventor: João Bosco de Oliveira, Rua Professor Alexandro Correia, 370, Apto. 71, Morumbi, São Paulo, SP (BR) 05657-230

( * ) Notice: Subject to any disclaimer, the term of this patent is extended or adjusted under 35 U.S.C. 154(b) by 0 days.

(21) Appl. No.: 11/210,154

(22) Filed: Aug. 23, 2005

(65) Prior Publication Data

US 2007/0048139 A1 Mar. 1, 2007

(51) Int. Cl.
*F04D 3/02* (2006.01)

(52) U.S. Cl. ..... 415/77; 415/91; 416/175; 416/203

(58) Field of Classification Search ..... 416/189, 416/176, 177; 415/77, 78, 79, 91, 72
See application file for complete search history.

(56) References Cited

U.S. PATENT DOCUMENTS

| | | | | |
|---|---|---|---|---|
| 952,969 | A * | 3/1910 | Whelan | 415/91 |
| 1,470,909 | A * | 10/1923 | Chapman | 415/126 |
| 3,655,294 | A * | 4/1972 | Thatcher | 415/91 |
| 3,804,553 | A | 4/1974 | Hickey | |
| 5,490,763 | A | 2/1996 | Abrams et al. | |
| 6,627,174 | B1 | 9/2003 | Judat et al. | |
| 2003/0186601 | A1 | 10/2003 | Collier et al. | |

FOREIGN PATENT DOCUMENTS

| | | | |
|---|---|---|---|
| DE | 20301041 | U1 | 9/2003 |
| FR | 2839266 | A1 | 11/2003 |

* cited by examiner

*Primary Examiner*—Richard Edgar
(74) *Attorney, Agent, or Firm*—Christopher & Weisberg, P.A.

(57) ABSTRACT

A cylindrical rotor with internal blades, configured by a ring of variable diameter and length according to necessity, as well as the blade quantity, pitch, surface and angle in its interior, being the assembly made of different materials.

4 Claims, 5 Drawing Sheets

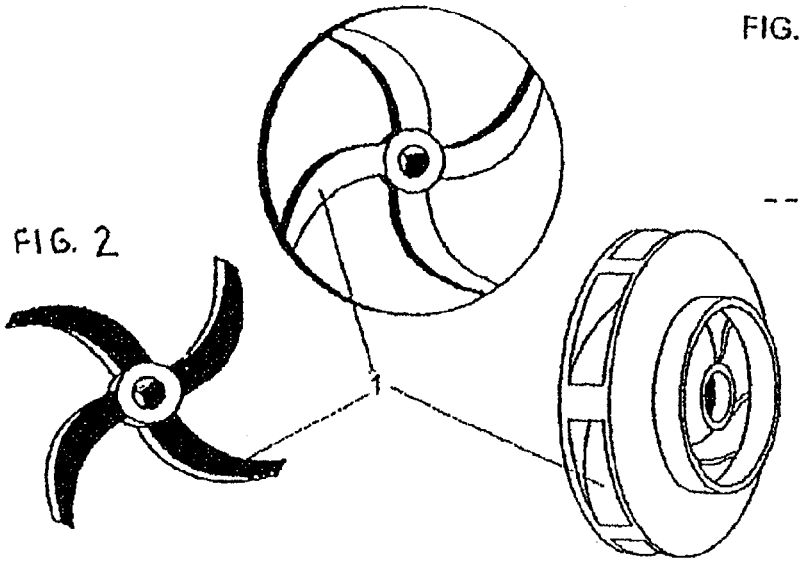
FIG. 1
-- PRIOR ART--
FIG. 2
FIG. 3
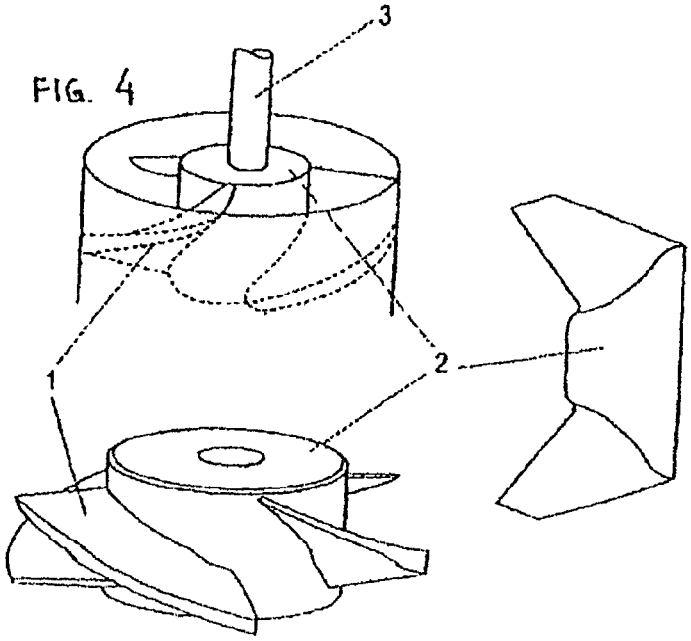
FIG. 4
FIG. 5
-- PRIOR ART--
FIG. 6

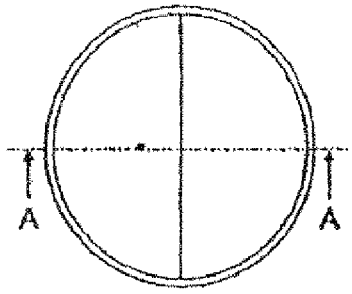
FIG. 7
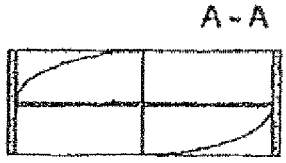
FIG. 8
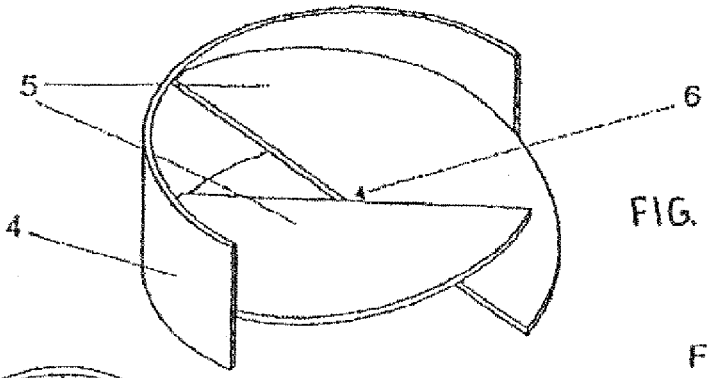
FIG. 9
FIG. 11
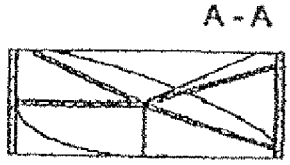
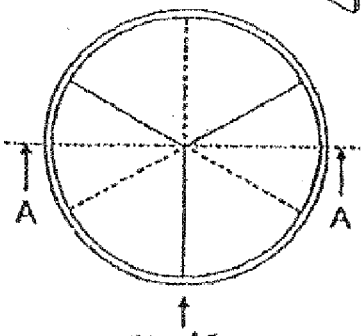
FIG. 10
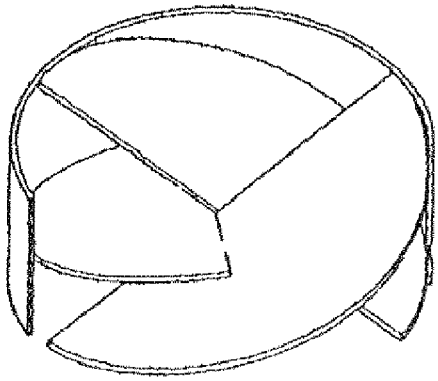
FIG. 12

FIG. 13
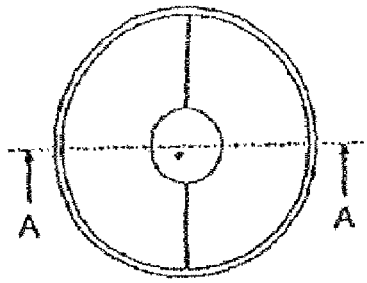
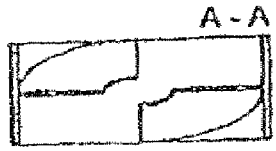
FIG. 14
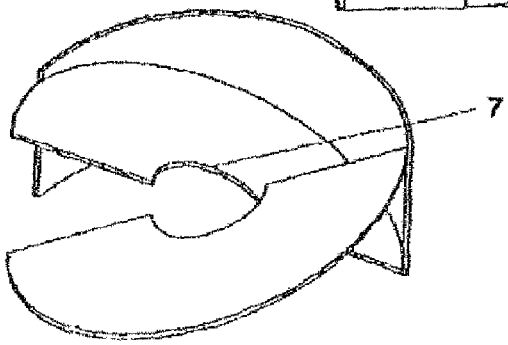
FIG. 15
FIG. 17
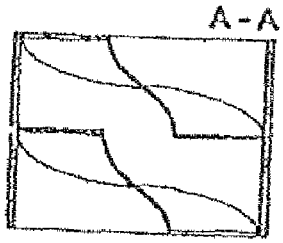
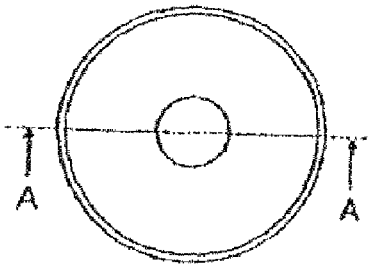
FIG. 16
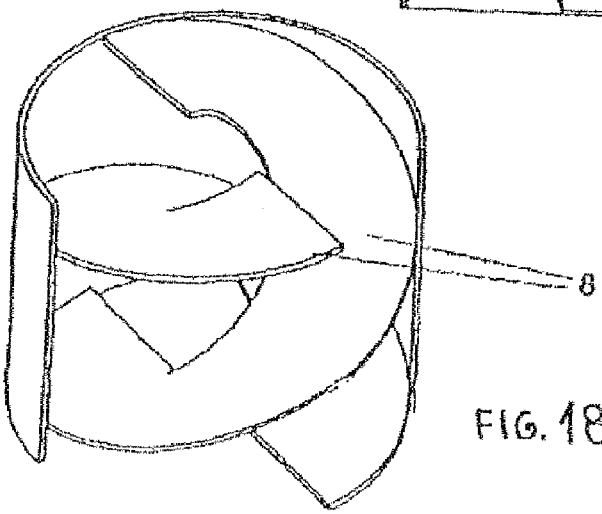
FIG. 18

FIG. 19
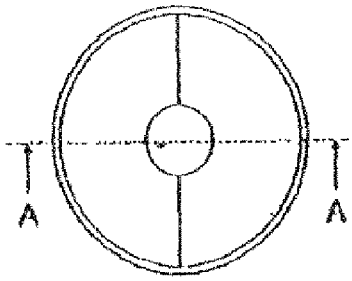
A-A
FIG. 20
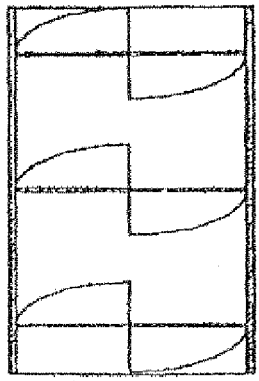
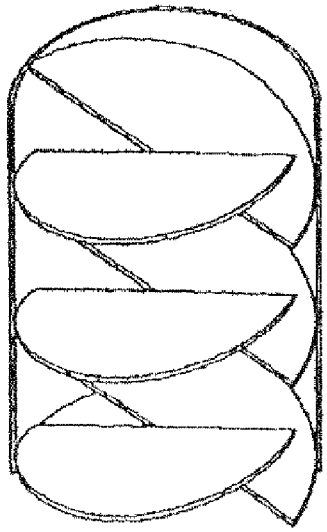
FIG. 21
FIG. 22
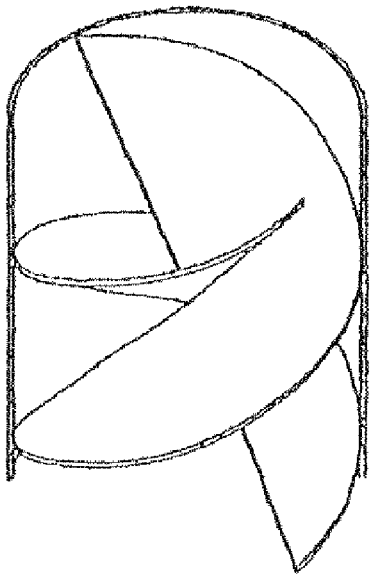
FIG. 23
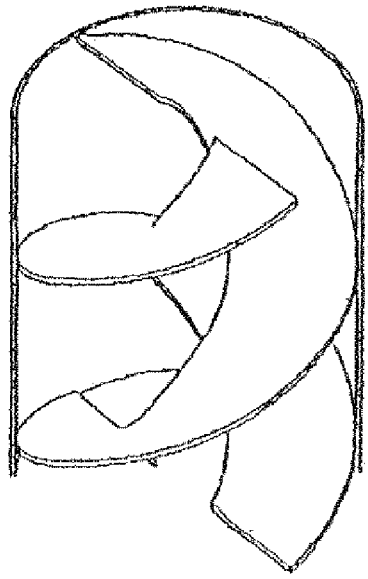

FIG. 24
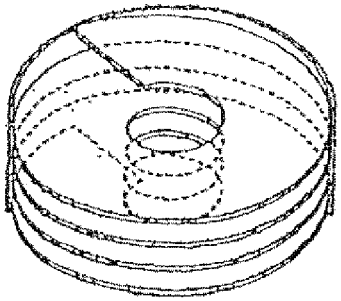
FIG. 25
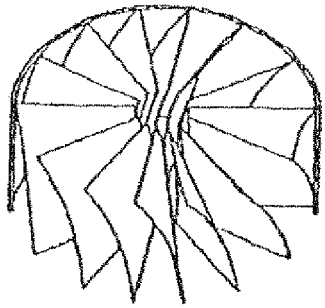
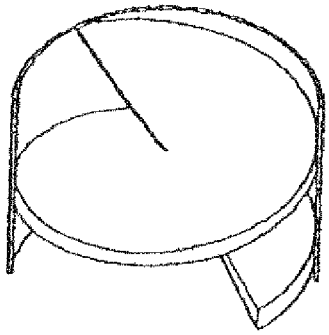
FIG. 26
FIG. 27
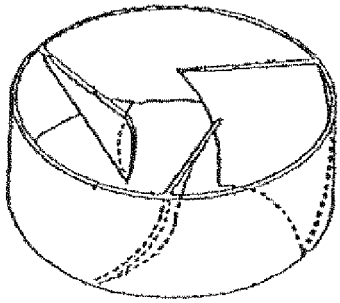
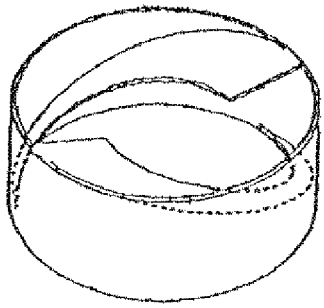
FIG. 28
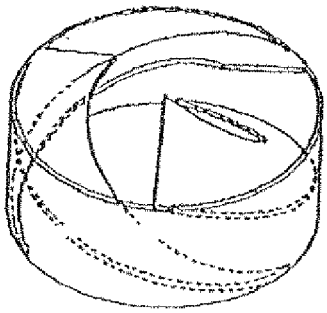
FIG. 29

CYLINDRICAL ROTOR WITH INTERNAL BLADES

FIELD OF THE INVENTION

The present invention is in the field of rotors, specifically of cylindrical rotors.

BACKGROUND OF THE INVENTION

The cylindrical rotor of the present invention presents internal blades and is constructed and arranged for axial flows in pumps or turbines. The flows can be liquid or gas flows with or without suspended sediments or particles.

In the present invention there is a load and flow gain related to the current axial flow rotors due to the absence of a cube and a central axis. This absence allows gases and liquids to flow without any obstruction.

Furthermore, in the present invention the accumulation of debris and particles are substantially minimized in its external and in its base. These accumulations are considered one of the main causes of rotor locking in cases of drainage of fluids with suspended sediments and particles.

The cylindrical rotor of the present invention may be made of several different materials such, but not limited to metal, polymer and porcelain.

SUMMARY OF THE INVENTION

This application seeks to provide a cylindrical rotor with internal blades comprising a ring (4) with an internal and an external surface, including at least two blades (5) including an internal and an external edge, located in the internal surface, wherein the blades present different configurations in angle, pitches and coil number; the blade different configurations based on calculations selected from the group consisting of: speed, hydraulic charge, kinetic height and combinations thereof.

This application also seeks to provide a cylindrical rotor with internal blades comprising a ring with an internal and an external surface, including at least two blades including an internal and an external edge, located in the internal surface, wherein the blades present different configurations in angle, pitches and coil number selected from the group consisting of: multiple straight semicircular blades with radials equal than the cylinder diameter, positioned in opposite directions, both placed at the same height and showing the same angle in relation to a horizontal plane (FIGS. 7-12); multiple straight semicircular blades with radials smaller than the cylinder diameter, positioned in opposite directions, both placed at the same height and showing the same angle in relation to a horizontal plane (FIGS. 13-15); multiple coil shape blades having theirs maximal size equivalent to half of the generatrix circumference that contains them (FIGS. 16-18); multiple helical blades of one long-coil pitch, with radials smaller than the cylinder diameter (FIG. 22); multiple helical blades of one long-coil pitch, with radials equal than the cylinder diameter, (FIG. 23); multiple layers coil-shape blades with radials smaller than the cylinder diameter (FIG. 24); multiple coil-shape blades with radials equal than the cylinder diameter (FIG. 26); Multiple multi-vane blades (FIG. 25); multiple three-converging concave blades (FIG. 27); two-converging helicoidal blades (FIG. 28); and multiple-converging helicoidal blades (FIG. 29), and wherein the blade different configurations based on calculations selected from the group consisting of: speed, hydraulic charge, kinetic height and combinations thereof.

This application also seeks to provide a cylindrical rotor with internal blades comprising a ring with an internal and an external surface, including at least two straight blades including an internal and an external edge, located in the internal surface, wherein the at least two straight blades are equidistantly positioned in opposite directions and placed at the same height and angle, wherein the straight blade is of a shape selected from the group consisting of: plain, concave, convex and helical.

BRIEF DESCRIPTION OF THE DRAWINGS

FIGS. 1, 2 and 3 show perspective views of conventional rotors to centrifuge pumps with axial or mixed flows.

FIGS. 4, 5 and 6 show perspective views of conventional rotors to centrifuge pumps with axial or mixed flows.

FIG. 7 shows a frontal view of a rotor with two straight blades.

FIG. 8 shows the A-A cross-section view of the rotor with two straight blades of FIG. 7.

FIG. 9 show a perspective view of a rotor with two straight blades.

FIG. 10 shows a frontal view of a rotor with three straight blades.

FIG. 11 shows the A-A cross-section view of the rotor with three straight blades of FIG. 10.

FIG. 12 shows a perspective view of a rotor with three straight blades.

FIG. 13 shows a frontal view of a rotor with two straight blades with radials smaller than the cylinder diameter.

FIG. 14 shows the A-A cross-section view of the rotor with two straight blades with radials smaller than the cylinder diameter of FIG. 13.

FIG. 15 shows a perspective view of a rotor with two straight blades with radials smaller than the cylinder diameter.

FIG. 16 shows a frontal view of a rotor with two helical blades of one coil with radials smaller than the cylinder diameter.

FIG. 17 shows the A-A cross-section view of the rotor with two helical blades of one coil with radials smaller than the cylinder diameter of FIG. 16.

FIG. 18 shows a perspective view of a rotor with two helical blades of one coil with radials smaller than the cylinder diameter.

FIG. 19 shows a frontal view of a rotor with prolonged cylindrical basis with three sets of straight blades.

FIG. 20 shows the A-A cross-section view of the rotor with prolonged cylindrical basis with three sets of straight blades of FIG. 19.

FIG. 21 shows a perspective view of a rotor with prolonged cylindrical basis with three sets of straight blades.

FIGS. 22 and 23 show perspective views of rotors with two helical blades of one long-coil pitch.

FIG. 24 shows a perspective view of a rotor with multiple coil-shape blades with radials equal to the cylinder diameter.

FIG. 25 shows a perspective view of a rotor with multiple-vane blades.

FIG. 26 shows a perspective view of a rotor with multiple coil-shape blades with radials equal to the cylinder diameter.

FIG. 27 shows a perspective view of a rotor with three-converging concave blades.

FIG. 28 shows a perspective view of a rotor with two-converging helicoidal blades.

FIG. 29 shows a perspective view of a rotor with multiple-converging helicoidal blades.

DETAILED DESCRIPTION OF THE INVENTION the present invention includes a cylindrical rotor with internal blades. The cylindrical rotor of the present invention comprises multiple blades of different dispositions and shapes. These possibilities overcome the drawbacks of pumps and turbines of the prior art. Blades (1) of conventional centrifuges (FIGS. 1-3) or axial pumps (FIGS. 4-6), although allowing several configurations, are limited by the cube (2) and central axis (3).

In FIGS. 7-9 a rotor it is shown, where a ring (4) including two internal semicircular blades (5), which may be plain, concave or convex blades. The two blades are positioned in opposite directions, both placed at the same height and showing the same angle in relation to a horizontal plane. The blades include an internal and an external edge, and a central portion of the internal edges (6) crosses the ring in a central axial position.

The blades being straight and the inlet and outlet angles being the same enables the efficiency of axial flow to be equivalent in both directions, taking into consideration that the potency and the speed in the opposite directions of rotation are the sense. This is also true for in rotors with three or more blades, as seen in FIGS. 10-12.

The internal edges (radial center) of the blades may also include a depression in a semicircular shape (7), also in a central position, as seen in FIGS. 13-15. In this case the width (radial measure) is smaller than the cylinder radius, being this rotor proper to be used with denser fluids.

The blades may also be in a coil shape (8), a seen in FIGS. 16-18. Coil shape blades are longer than straight blades, which have their maximal size equivalent to half of the generatrix circumference that contains them.

The possibility of prolonging the blades is a significant advantage of the present invention over conventional rotors of axial flows of the prior art, which, in general, have the size of their blades proportional to size of the cube. In the rotor of the present invention this is avoided as the cylindrical and external basis enables, when prolonged, the rotor to comport coils with extremely large pitches, as seen in FIGS. 22-23. The rotor of this invention also enables the rotor to comport two or more blades sets in its interior, as seen in FIGS. 19-21. These characteristics will simulate an axial pump of several stages, leading to a significant gain in flow pressure.

In FIG. 24 it is shown that when the blades are in a coil shape the blades also enable the rotor to present a specific configuration based on speed calculations, hydraulic charge, kinetic height, and etc, increasing or decreasing the pitch, angle, coil number and other relevant factors.

Due to the absence of a cube and as a result an absence of a central axis, the transmission movement is made through belts, pulleys, gears, magnetic or electromagnetic induction, and also made in according to the desired use, capacity, size, potency and other determining factors.

These different transmission types are also applied to rotors used in turbines, where they are used to transform mechanical-rotational work in kinetic energy of a moving fluid.

Blades may also be defined as paddles or propellers.

The invention claimed is:

1. A cylindrical rotor comprising:

a ring, the ring including:
- an internal surface;
- an external surface; and at least two straight blades located in the internal surface, each blade including:
- an internal edge; and
- an external edge;
- the at least two straight blades:
  - presenting different configurations in pitches and coil number;
  - being equidistantly positioned in opposite directions;
  - being placed at the same height and angle, and a central portion of the internal edges crosses the ring in a central axial position.

2. A cylindrical rotor comprising:

a ring, the ring including:
- an internal surface;
- an external surface; and at least two blades located in the internal surface, each blade having:
- an internal edge; and
- an external edge, the at least two blades present a configuration in angle, pitches and coil number selected from the group consisting of:
- multiple straight semicircular blades with radials equal than the cylindrical rotor diameter, positioned in opposite directions, both placed at a same height and showing a same angle in relation to a horizontal plane; and
- multiple straight semicircular blades with radials smaller than the cylindrical rotor diameter, positioned in opposite directions, both placed at the same height and showing the same angle in relation to a horizontal plane.

3. The cylindrical rotor of claim 2, wherein the at least two blades present a configuration in angle, pitches and coil number selected from the group further consisting of:
- multiple coil shape blades having their maximum size equal to half of a generatrix circumference that contains them;
- multiple helical blades of one long-coil pitch, with radials smaller than the cylindrical rotor diameter;
- multiple helical blades of one long-coil pitch, with radials equal to the cylindrical rotor diameter;
- multiple layers coil-shape blades with radials smaller than the cylindrical rotor diameter;
- multiple coil-shape blades with radials equal to the cylindrical rotor diameter;
- multiple vane-blades;
- multiple three-converging concave blades;
- two-converging helicoidal blades; and
- multiple-converging helicoidal blades.

4. The cylindrical rotor according to claim 2, wherein when the blades present radials smaller than the cylindrical rotor diameter, the internal edge of each blade further includes a depression in a semicircular shape in a central position.

* * * * *